US005924498A

United States Patent [19]

Nilsen

[11] Patent Number: 5,924,498

[45] Date of Patent: Jul. 20, 1999

[54] PRESSURE CONVERTER III

[75] Inventor: Nils Inge Nilsen, Kvernaland, Norway

[73] Assignee: Den Norske Stats Oljeselskap a.s., Stavanger, Norway

[21] Appl. No.: 08/817,087

[22] PCT Filed: Oct. 5, 1995

[86] PCT No.: PCT/NO95/00179

§ 371 Date: Apr. 11, 1997

§ 102(e) Date: Apr. 11, 1997

[87] PCT Pub. No.: WO96/12083

PCT Pub. Date: Apr. 25, 1996

[30] Foreign Application Priority Data

Oct. 12, 1994 [NO] Norway ..... 943857

[51] Int. Cl.[6] ..... E21B 7/18; E21B 21/00

[52] U.S. Cl. ..... 173/206; 173/218; 173/222; 173/93

[58] Field of Search ..... 173/93, 93.5, 206, 173/207, 218, 219, 220, 221, 222; 91/181, 183; 60/533, 322, 327; 175/67

[56] References Cited

U.S. PATENT DOCUMENTS

| | | | |
|---|---|---|---|
| 3,319,723 | 5/1967 | Kramer | 173/220 |
| 3,951,217 | 4/1976 | Wallace et al. | 173/218 |
| 4,854,395 | 8/1989 | Rassieur et al. | 173/218 |
| 5,199,504 | 4/1993 | Dang | 173/206 |
| 5,217,079 | 6/1993 | Kettner et al. | 173/93 |
| 5,231,902 | 8/1993 | Uno et al. | 173/220 |
| 5,437,338 | 8/1995 | Martin et al. | 173/222 |
| 5,526,885 | 6/1996 | Kuvshinov et al. | 173/207 |

*Primary Examiner*—Scott A. Smith
*Attorney, Agent, or Firm*—Foley & Lardner

[57] ABSTRACT

A pressure amplifier can be mounted above a drill bit at the lower end of a drill pipe for generating an increased fluid pressure in a drilling fluid flow to, for example, obtain an increased drilling effect, A reciprocating piston in a cylinder has at one side (a low pressure side) a large piston area and also has a first opposite piston area and a second opposite and relatively small piston area, which generates an increased pressure. A valve device controls drilling fluid flows to and from the piston. Beyond one end of the cylinder there is provided a hydraulic rotary motor adapted to be driven by the pressure difference between the drilling fluid flows in the drill pipe and an annulus. A transmission mechanism converts the rotation of the hydraulic motor into intermittent movements of the valve device between two operative positions.

31 Claims, 5 Drawing Sheets

PRESSURE CONVERTER III

BACKGROUND OF THE INVENTION

1. Field of the Invention

This invention relates to an improved design of a pressure amplifier or converter for mounting above the drill bit at the lower end of a drill pipe for deep drilling, in particular for oil and gas, and for generating an increased fluid pressure by utilizing energy in a drilling fluid flow downwards through the drill string and the drill pipe. This may be, inter alia, for the purpose of obtaining an enhanced drilling effect, preferably by means of one or more high pressure jets adapted to have a cutting effect in the surrounding rock.

2. Description of the Related Art

The invention can be regarded as a further development and improvement of structures being described in Norwegian Patent Specifications Nos. 169.088, 171.322, 171.323 and 171.325. Norwegian Patent 171.323 is particularly directed to a valve assembly for this type of pressure converter, which advantageously can be replaced by new and improved designs to be described in the following description.

SUMMARY OF THE INVENTION

These new designs involve, inter alia, less wear of vital valve parts and besides better reliability and safety under the extreme conditions that the structures are subjected to in actual practice.

As in the pressure converters according the above mentioned Norwegian Patent Specifications, the present invention takes its starting point in an arrangement comprising a reciprocating piston having a pressure stroke and a return stroke between opposite end positions in a cylinder, and being at one side (low pressure side) provided with a relatively large piston area which during the pressure stroke is subjected to the drilling fluid pressure in the drill pipe, a first opposite area and a second, opposite and relatively small piston area which during the pressure stroke generates an increased pressure in a smaller portion (high pressure side) of the drilling fluid flow, valve means for controlling drilling fluid flows to and from the piston, a channel for connecting a space in front of the first, opposite piston area to the annulus outside the drill pipe at least during the pressure stroke, a second channel with a check valve, connecting said high pressure side to a high pressure channel leading forward to the drill bit, and at least one additional channel being adapted to connect the low pressure side to the annulus outside the drill pipe during the return stroke.

As an important component in the solution according to the invention there is incorporated a hydraulic motor, and in this connection it is to be noted that hydraulic motors in principle are known for use at the lower end of drill pipes for deep drilling, as for example described in U.S. Pat. No. 3.112.800, European patent publication 335.543 and international patent publication WC 83/00183. In these known uses, however, the hydraulic motor has other purposes and functions than what is contemplated in connection with the present invention.

What is novel and specific in the pressure converter according to the invention in the first place comprises therein that it comprises a hydraulic rotary motor arranged beyond the end of the cylinder and adapted to be driven by the pressure difference between the drilling fluid flows in the drill pipe and the annulus, and that a transmission mechanism is adapted to convert the rotation of the hydraulic motor into intermittent re-positioning movements of the valve means between two operative positions.

The present invention provides a pressure converter for mounting above a drill bit at a lower end of a drill pipe for deep drilling and for generating fluid pressure higher than pressure in a drilling fluid flow downwards through a drill string and the drill pipe. The pressure converter includes a reciprocating piston having a pressure stroke and a return stroke between opposite end positions in a cylinder, and being provided at one side with a main piston area which during a pressure stroke is subjected to the drilling fluid pressure in the drill pipe, a first opposite piston area, and a second opposite piston area being relatively small compared to the main piston area, which during the pressure stroke generates the higher fluid pressure in a small portion of the drilling fluid flow. The pressure converter also includes a valve device that controls drilling fluid flow to and from the piston, a channel for connecting a space in front of the first opposite piston area to an annulus outside the drill pipe at least during the pressure stroke, a second channel with a check valve, connecting the small portion of the drilling fluid flow to a high pressure channel leading forward to the drill bit, at least one additional channel providing fluid communication between the main piston area and the annulus outside the drill pipe during the return stroke, a hydraulic rotary motor arranged outside one end of the cylinder and that can be driven by a pressure difference between the drilling fluid in the drill pipe and the annulus, and a transmission mechanism that converts the rotation of the hydraulic motor into movements of the valve device between at least two operative positions.

In a further aspect of the invention, the hydraulic motor includes an output axle that is one of parallel with and coincident with a longitudinal axis of the pressure converter. The hydraulic motor can be a hydraulic gear wheel motor.

In a further aspect of the invention, a regulating device can be provided for the hydraulic motor. The regulating device preferably provides automatic control as a function of the pressure difference.

In a further aspect of the invention, the transmission mechanism converts continuous rotation of the output axle into intermittent movements of the valve device. The transmission mechanism preferably includes a Maltese cross mechanism. The Maltese cross mechanism can include a main disc mounted on the output axle of the hydraulic motor. Also, the main disc preferably includes at least one driving pin and has radial dimensions substantially larger than radial dimensions of cooperating slit wheels.

In a further aspect of the invention, the valve device includes two separate valve bodies located in a wall of the cylinder. The valve bodies preferably are diametrically positioned relative to an axis of the piston. Each valve body preferably comprises at least one valve ball that rotates approximately 90° between open and closed positions. Also, each valve body can have a longitudinal extension in parallel with an axis of the piston and corresponding in length at least to the stroke of the piston.

The present invention also provides a pressure converter group for mounting above a drill bit at a lower end of a drill pipe for deep drilling and for generating fluid pressure higher than pressure in a drilling fluid flow downwards through a drill string and the drill pipe. The pressure converter group comprises a plurality of pressure converters, wherein at least one of the pressure converters is designed in the manner stated above. The pressure converter group also includes a high pressure channel running continuously through all pressure converters in the pressure converter group, and through-running couplings for transferring rotary movements from a valve body in one pressure converter to a valve body in another pressure converter in the pressure converter group.

In a further aspect of the invention, the valve bodies in the pressure converters have alternate, mutual angular displacements (preferably 90°) about common longitudinal axes for equalizing the resulting pressure impulses in the high pressure channel.

In a further aspect of the invention, the pressure converters in the pressure converter group do not have a separate control cylinder and actuator cylinder.

BRIEF DESCRIPTION OF THE DRAWINGS

In the following description, the new structural solutions according to the invention as well as additional advantages and specific features thereof, will be more closely explained with reference to the drawings, wherein.

DETAILED DESCRIPTION OF THE INVENTION

Since the present pressure converter as far as the main features thereof are concerned, except for the valve arrangement, is closely related to corresponding structures according to the above mentioned Norwegian Patent Specifications, it seems to be sufficient here just to include a short discussion of these main features and functions.

Figure 1:
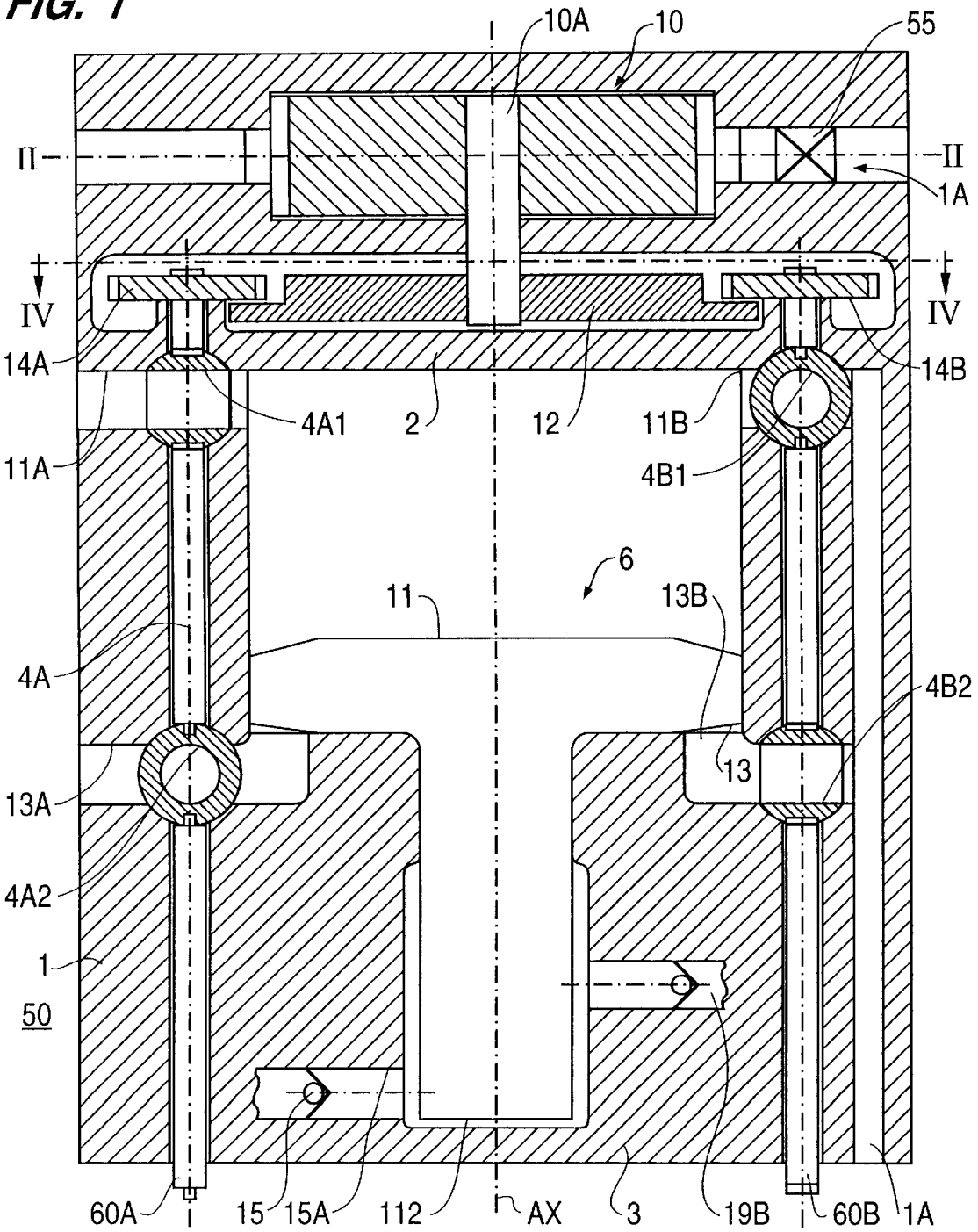
FIG. 1 shows a longitudinal sectional view of an embodiment of a pressure converter according to the invention, wash the piston in a lower end position.

As in the previously proposed designs, the embodiment of FIG. 1 comprises a generally cylindrical housing 1, 2 and 3 adapted to accomodate the piston 6. This has three active piston areas, i.e. and upper relatively large piston area 11, a first opposite piston area 13 and a second opposite and relatively small piston area 112 at the lower end of piston member 6. This is adapted to be freely movable axially under the influence of varying drilling fluid pressure on the respective piston areas.

The space or volume in front of piston area 11, can be designated low pressure space, whereas the volume in front of piston area 112 correspondingly can be denoted high pressure space. This latter space is connected through a channel 15A with a check valve 15, to a header channel (not shown in FIG. 1) for the resulting drilling fluid flow at an increased pressure. The channel runs through the whole longitudinal direction of the housing, i.e. the cylinder wall 1, for the purpose of interconnecting several such pressure converter units into a group, as will be discussed below with reference to FIG. 5.

The valve arrangement according to the invention as shown in FIGS. 1–4, comprises two rotatable valve bodies 4A and 4B each provided with respective through-flow openings 4Al, 4A2 and 4B1, 4B2. These valve bodies are provided in the cylinder wall 1 and diametrically opposite to one another. Valve bodies 4A and 4B with their respective valve balls preferrably are adapted to be rotated through an angle of about 90° between open and closed positions. In FIG. 1 there is accordingly a free opening for flow through the valve balls 4A1 and 4B2, whereas the other two are closed. A novel and specific control and actuator device for bringing about the above re-positioning movements of the valve bodies 4A and 4B, will be explained more closely below. At this point, a short discussion of the main function of the pressure converter shall be given.

Starting from the situation in FIG. 1 where piston 6 is in the lower position and valve ball 4B2 admits drilling fluid to the lower side of the piston through the inlet channel 13B, piston 6 will be urged upwards. Fluid being present in front of piston area 11 at the upper side of piston 6, thereby will flow out through channel 11A with the open valve ball 4A1 to the annulus 50 between the drill string or the cylinder wall 1 and the casing (not shown). Thus, piston 6 will be driven upwards to its top position. Accordingly this represents a return stroke of the piston. The pressure or working stroke takes place upon valve re-positioning, as will be seen without any closer explanation here.

Outside the cylinder end wall 2 at the low pressure side FIG. 1 shows the particular control and actuator apparatus according to the invention, being based on a hydraulic rotary motor 10 which has an output axle 10A. A first embodiment of the hydraulic motor is shown somewhat more in detail in FIG. 2. The motor is driven by the pressure difference between the drilling fluid flow in the drill pipe (indicated at 1A) and the annulus 50, respectively. It will be realized that only a very small proportion of the total drilling fluid flow is utilized in the hydraulic motor 10, which only serves for the movement of the valve device, as will be explained in the following description. It can be an advantage that the drilling fluid flow through the hydraulic motor, and thereby the power or rotational speed thereof, is adjustable. For that purpose there is indicated quite schematically a regulating device 55 for in-flowing drilling fluid from the drill pipe, as represented by the channel 1A, to the motor. Suitable regulation takes place as a function of the pressure difference mentioned above, so that the rotational speed varies to a lower degree than the pressure difference. Under the practical and varying operational conditions the rotary motor in the pressure converter according to the invention, will have a mechanical power, i.e. torque, for the required valve movement.

Figure 4:
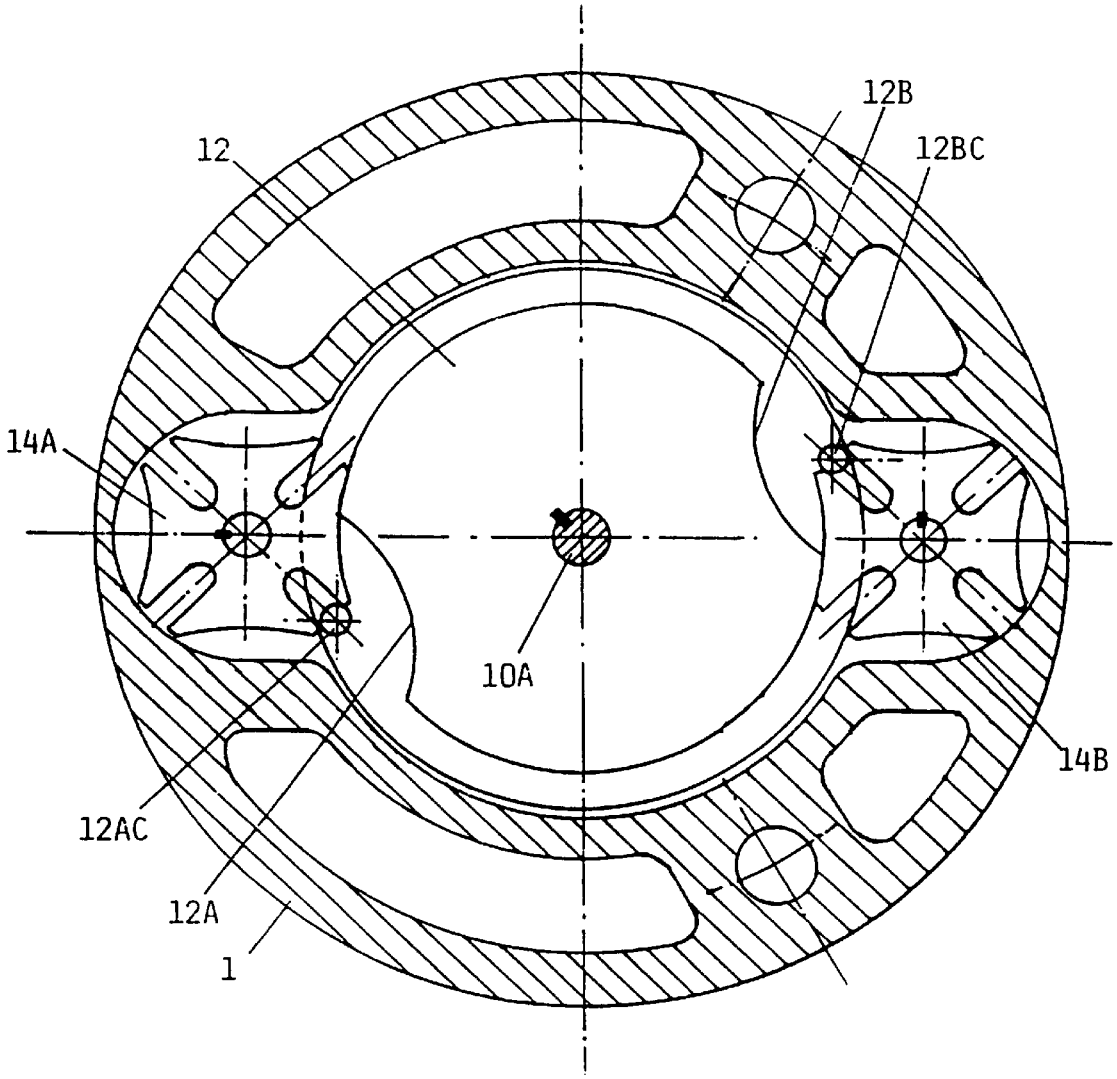
FIG. 4 shows a cross-section along the line IV—IV in FIG. 1, and FIG. 5 schematically shows a group of pressure converters based upon an upper pressure converter according to the embodiment in FIGS. 1–4, coupled to other pressure converters which have a simplified design.

FIG. 1, moreover, shows a transmission mechanism for converting the rotation of output axle 10A into adequate valve movements in the valve device described above. The transmission mechanism is shown in cross-sectional view in FIG. 4 and in this embodiment is based upon the Maltese cross principle. On the output axle 10A there is mounted a main disc 12 having recesses 12A and 12B in the circumference, for cooperation with slit wheels 14A and 14B each being rotationally connected to a valve body 4A and 4B. Furthermore FIG. 4 shows two pins 12AC and 12BC provided on the main disc 12 and centrally outside the recess portions 12A and 12B. This Maltese cross mechanism, as known per se, during continuous rotation of output axle 10A of the hydraulic rotor and thereby the main disc 12, will cause an intermittant rotary movement by 90° for each time, by engagement between the pins 12AC and 12BC and the slits shown in the two small wheels 14A and 14B. In the time interval between the valve re-positioning movements the two small slit wheels and accordingly the valve bodies will be maintained in a substantially fixed position by cooperation between the more extended circular surfaces on the main disc 12 and the wheels 14A and 14B respectively, as also known per se.

For the purpose of obtaining a desired quick re-positioning movement of the valve device, it is an advantage that the main disc 12 with associated pin or pins 12AC, 12BC has radial dimensions being substantially larger than the radial dimensions of the cooperating slit wheels 14A, 14B. Expressed in other words this means that the angle of rotation covered by the main disc 12 with pins 12Ac and 12BC in engagement with slit wheels 14A and 14B, is very small compared to one half revolution, which in principle represents the time interval between each valve re-positioning.

Transmission mechanisms other than the one being just described here, may be able to convert the rotation of the hydraulic motor 10 into desired re-positioning movements of the valve device. For the practical design of such transmission mechanisms it is a great advantage according to the invention that the output axle 10A from the hydraulic motor 10 is parallel to and can possibly coincide with the longitudinal axis AX of the pressure converter as a whole.

Moreover it is possible to incorporate desired transmission ratios in the transmission mechanism, including the employment of planetary gears. In this connection it will usually be the question of gearing down from the rotary speed of the hydraulic motor.

Figure 2:
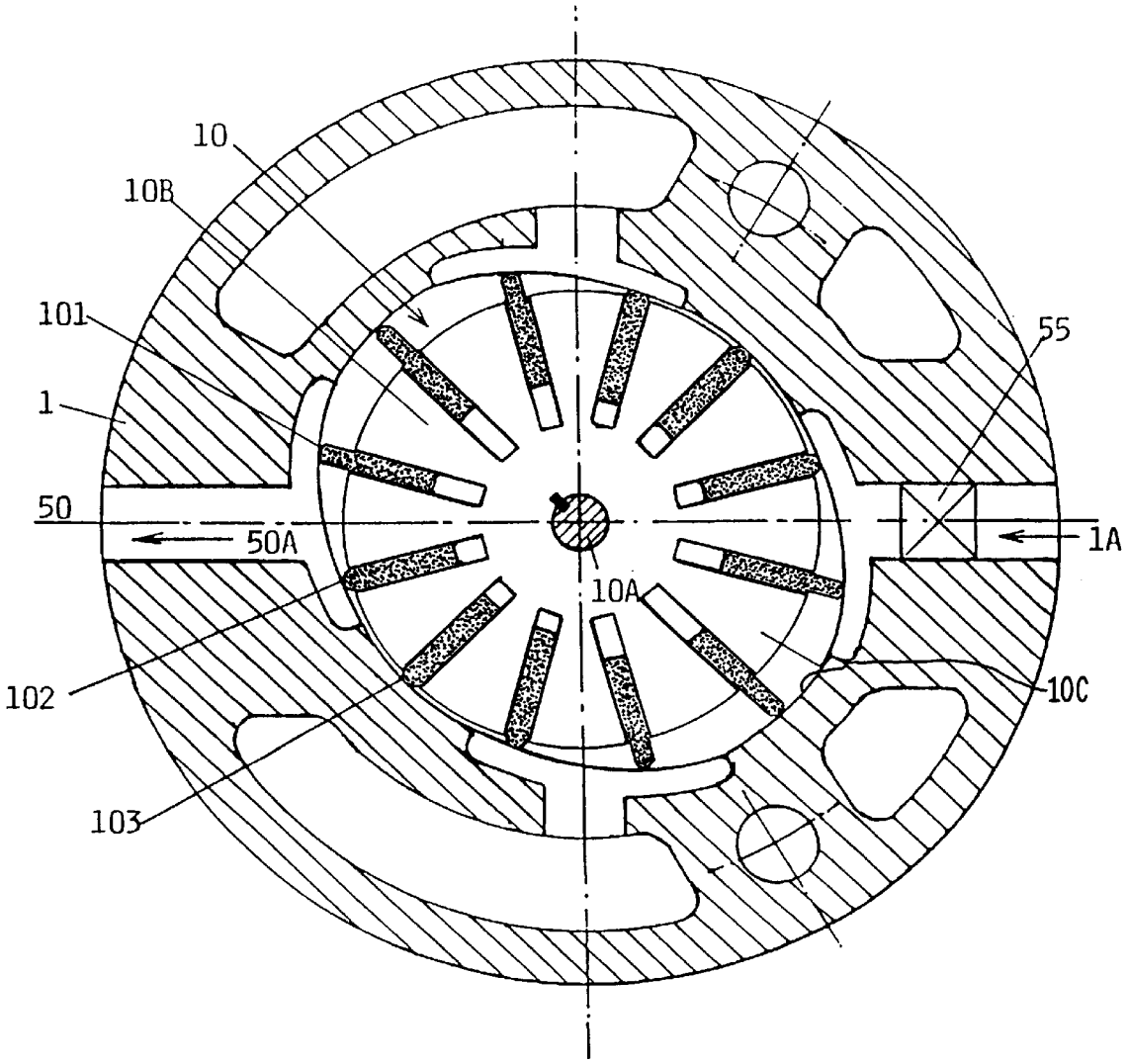
FIG. 2 shows a cross-sectional view along lines II—II in FIG. 1.

Considering now more closely the cross-section in FIG. 2, it appears that the hydraulic motor 10 in this embodiment more specifically has the form of a wing motor having a number of wings or vanes 101,102,103 and so forth, being mounted for radial translation in a rotor 10B which is keyed to the output axle 10A. The rotor with the wings is arranged in a cavity 10c the circumference of which has a non-circular or oval shape being so oriented in relation to inlet 1A and outlet 50A to the annulus 50, that rotation is obtained by the pressure difference already mentioned above. This motor principle as such is previously known per se.

Figure 3:
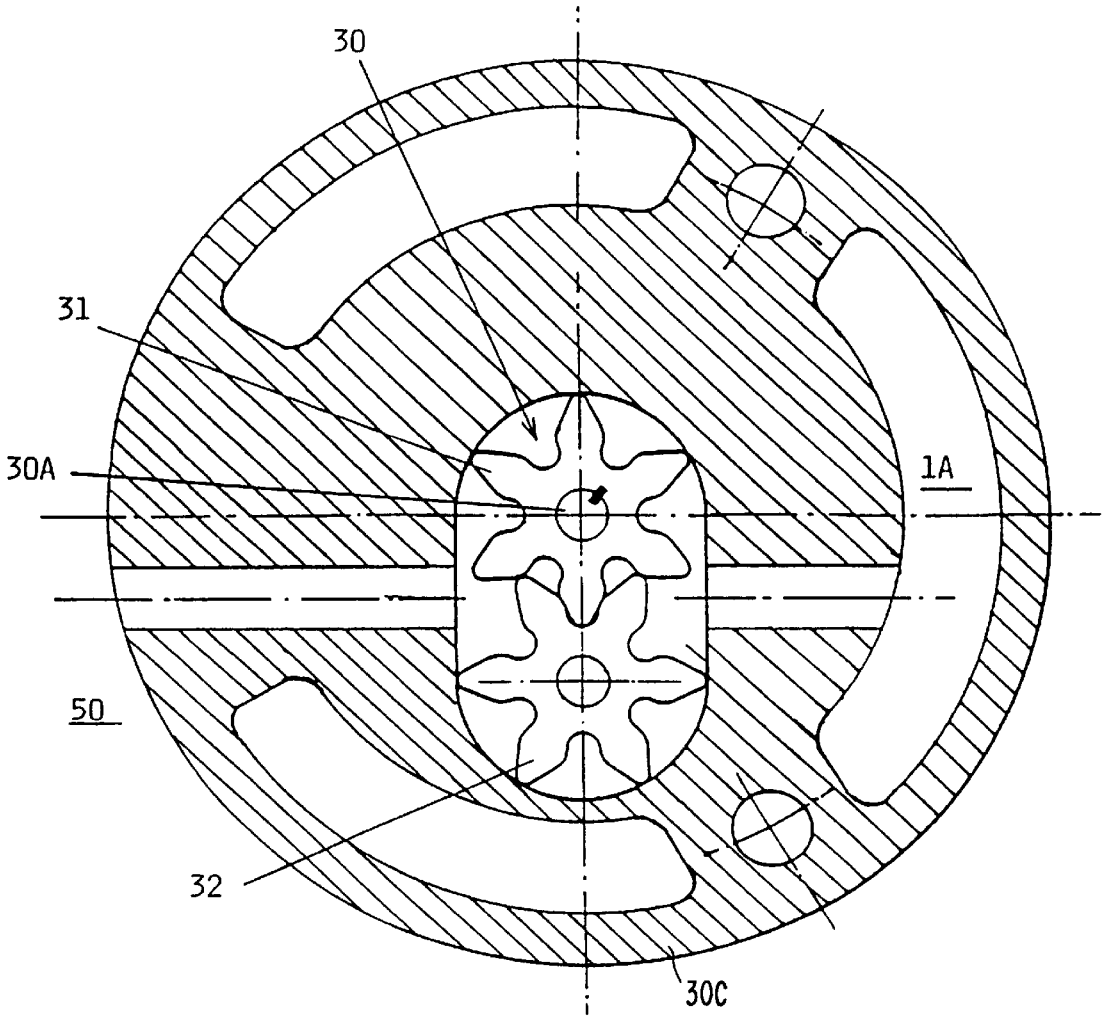
FIG. 3 shows a cross-sectional view similar to FIG. 2, but with a more preferred design of the hydraulic motor.

In practice the motor design according to FIG. 2 can be subject to drawbacks, as a consequence, inter alia, of the relatively numerous individual parts being subjected to wear and tear, and therefore according to the invention it is a much preferred embodiment to employ a gear wheel motor as illustrated in FIG. 3. This is likewise a principle known per se for a hydraulic motor, comprising two gear wheel rotors 31 and 32 for rotation in engagement with one another in a housing 30C which incorporates half-cylindrical wall portions in cooperation with the rotating tooth tops on gear wheels 31 and 32. The resulting hydraulic motor 30 preferably has an output axle 30A carrying the gear wheel 31, located so as to coincide with the pressure converter axis AX (as shown in FIG. 1), for direct coupling to the main disc 12 in the transmission mechanism in FIGS. 1 and 4, or some other form of suitable transmission mechanism. In FIG. 3 there are more particularly also shown drilling fluid channel 1A which supplies drilling fluid under pressure as a portion of the total drilling fluid flow in the drill string and the drill pipe. With arrows at both gear wheels 31 and 32 the direction of rotation thereof during operation is indicated.

In the embodiment of FIG. 1, where there are provided valve balls both for inlets and outlets at either side of the main piston areas or surfaces 11 and 13, each valve body 4A and 4B has a longitudinal extension in parallel with the axis of piston 6, corresponding at least to the stroke of the piston. These dimensional relationships are determined by the need for supplying drilling fluid under pressure onto piston area 11 during the pressure stroke, and onto piston area 13 during the return stroke, respectively. However, a modified embodiment may be contemplated, wherein each valve body has only one valve ball, i.e. ball 4A1 and 4B1 respectively. In such a modified embodiment there is no valve function controlling in-flow or out-flow from the volume in front of piston area 13, since this volume via a fully open channel corresponding to 13A, communicates directly with the annulus 50 during all movement stages of piston 6. This is per se a solution being also previously described, inter alia, in Norwegian patent 169.088. As in the previous design the modified solution mentioned here can also comprise a return compression spring adapted to exert a pushing force against piston area 13.

Also with respect to the valve and actuator device the present invention can comprise embodiments having other structural features than those discussed above with reference to the drawings. Thus, for example the valve means or arrangement can be based un a plate-shaped, rotatable valve body as described in Norwegian patent No. 169.088. Instead of an actuator cylinder with a linear movement as shown and described herein, also other forms of hydraulic actuators can be contemplated, being controlled by a control valve as described.

Besides, the solutions being described above with reference to the figures of drawings, can be combined with some of the particular variants being shown in Norwegian patent specifications mentioned above, perhaps in particular the outlet channel according to Norwegian patent 171.322 and the inter-connection into a pressure converter group according to Norwegian patent No. 171.325.

Figure 5:
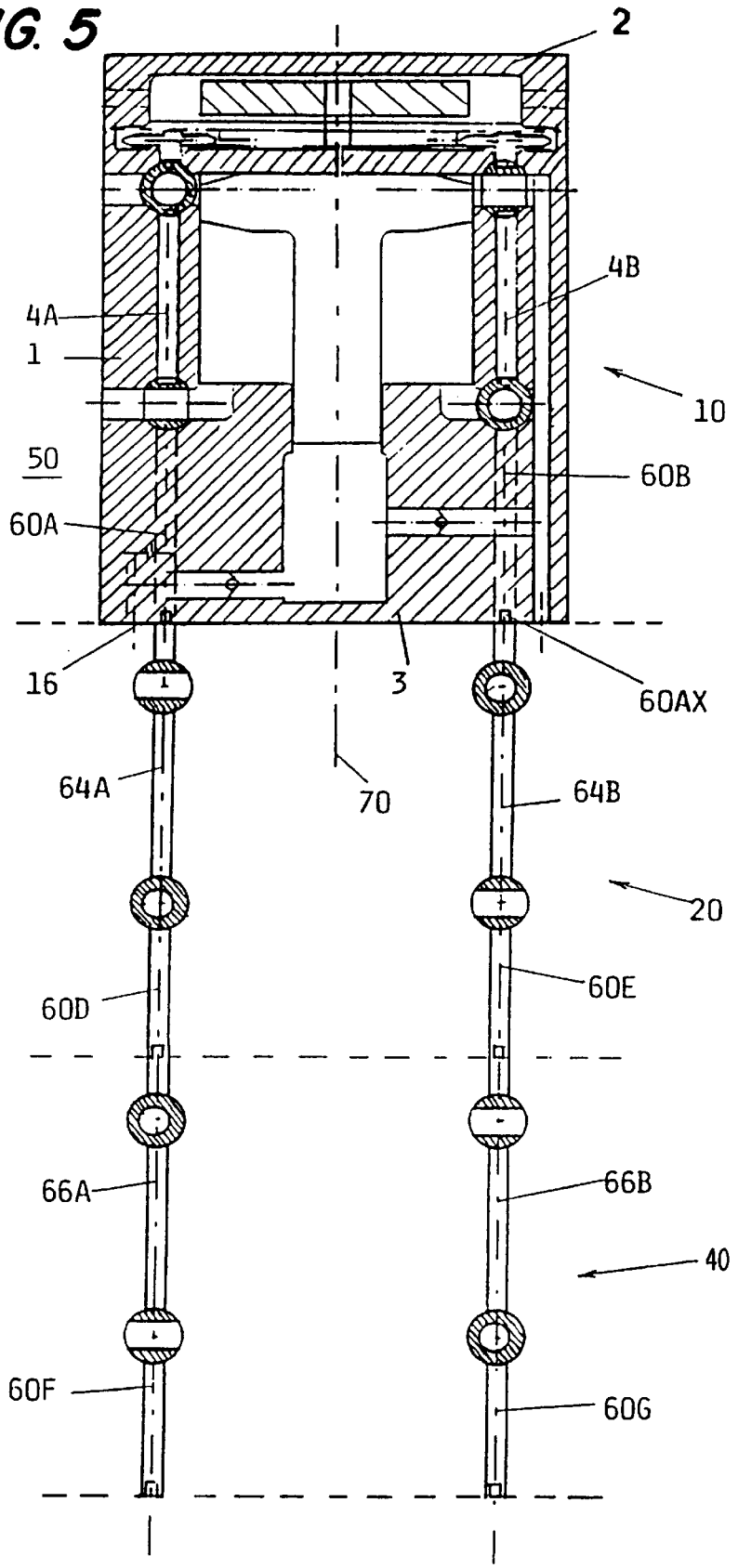

As in the previously known designs, in particular as described in Norwegian patent specifications Nos. 169.088 and 171.325, a pressure converter according to the present invention can be incorporated in a croup of pressure converters for generating a resulting, larger drilling fluid flow at the desired, increased pressure. FIG. 5 shows such a pressure converter group, wherein an upper pressure converter 10 is illustrated in the form of the same pressure converter embodiment as in FIGS. 1–4. Moreover in FIG. 5 there is schematically shown two further pressure converters 20 and 40, which possibly can be followed by still further pressure converters below them, all being provided with valve bodies with inter-connections in the whole longitudinal direction of the group so that valve bodies 4A and 4B in the uppermost pressure converter 10, drive the whole series of valve bodies below, such as valve bodies 64A and 64B in pressure converter 20 and valve bodies 66A and 66B in pressure converter 40. These further pressure converters, for example 20 and 40 therefore can be of a simplified design without any specific means for bringing about the re-setting movement of their valves.

As in the previously described pressure converter groups the pressure converters 10, 20, 40 and so forth as illustrated here, are aligned along a common longitudinal axis 70, with a common, through-running high pressure header channel 16 and with the respective valve bodies axially aligned in relation to each other. For inter-connecting the two strings of valve bodies shown, there are provided drive axles 60A, 60B, . . . 60G with associated axle couplings as shown for example at 60AX between pressure converter 10 and pressure converter 20.

For equalizing pressure impulses in the total resulting high pressure flow in channel 16, it may be an advantage to arrange the valve bodies in the pressure converters with angular orientations being alternately opposite, as will appear from the valve positions being indicated for the respective valve bodies in pressure converters 10, 20 and 40 in FIG. 5.

What is claimed is:

1. A pressure converter for mounting above a drill bit at a lower end of a drill pipe for deep drilling and for generating fluid pressure hither than pressure in a drilling fluid flow downwards through a drill string and the drill pipe, comprising:

a reciprocating piston having a pressure stroke and a return stroke between opposite end positions in a cylinder, and being provided at one side with a main piston area which during a pressure stroke is subjected to the drilling fluid pressure in the drill pipe, a first opposite piston area, and a second opposite piston area being relatively small compared to said main piston area, which during the pressure stroke generates said higher fluid pressure in a small portion of the drilling fluid flow;

a valve device that controls drilling fluid flow to and from the piston;

a channel for connecting a space in front of said first opposite piston area to an annulus outside the drill pipe at least during the pressure stroke;

a second channel with a check valve, connecting said small portion of the drilling fluid flow to a high pressure channel leading forward to the drill bit;

at least one additional channel providing fluid communication between the main piston area and the annulus outside the drill pipe during the return stroke;

a hydraulic rotary motor arranged outside one end of the cylinder and that can be driven by a pressure difference between the drilling fluid in the drill pipe and the annulus; and a transmission mechanism that converts the rotation of the hydraulic motor movements of said valve device between at least two operative positions.

2. A pressure converter according to claim 1, wherein the hydraulic motor includes an output axle that is one of parallel with and coincident with a longitudinal axis of the pressure converter.

3. A pressure converter according to claim 2, wherein the transmission mechanism converts continuous rotation of said output axle into intermittent movements of said valve device.

4. A pressure converter according to claim 3, wherein the transmission mechanism includes a Maltese cross mechanism.

5. A pressure converter according to claim 4, wherein said Maltese cross mechanism includes a main disc mounted on the output axle of the hydraulic motor.

6. A pressure converter according to claim 5, wherein the main disc includes at least one driving pin and has radial dimensions substantially larger than radial dimensions of cooperating slit wheels.

7. A pressure converter according to claim 3, wherein the valve device includes two separate valve bodies located in a wall of said cylinder.

8. A pressure converter according to claim 7, wherein each valve body comprises at least one valve ball that rotates approximately 90° between open and closed positions.

9. A pressure converter according to claim 7, wherein each valve body has a longitudinal extension in parallel with an axis of said piston and corresponding in length at least to the stroke of the piston.

10. A pressure converter according to claim 7, wherein the valve bodies are diametrically positioned relative to an axis of the piston.

11. A pressure converter according to claim 2, further comprising a regulating device for the hydraulic motor.

12. A pressure converter according to claim 11, wherein the regulating device provides automatic control as a function of the pressure difference.

13. A pressure converter according to claim 11, wherein the transmission mechanism converts continuous rotation of said output axle into intermittent movements of said valve device.

14. A pressure converter according to claim 13, wherein the transmission mechanism includes a Maltese cross mechanism.

15. A pressure converter according to claim 14, wherein said Maltese cross mechanism includes a main disc mounted on the output axle of the hydraulic motor.

16. A pressure converter according to claim 15, wherein the main disc includes at least one driving pin and has radial dimensions substantially larger than radial dimensions of cooperating slit wheels.

17. A pressure converter according to claim 2, wherein the valve device includes two separate valve bodies located in a wall of said cylinder.

18. A pressure converter according to claim 17, wherein each valve body comprises at least one valve ball that rotates approximately 90° between open and closed positions.

19. A pressure converter according to claim 17, wherein each valve body has a longitudinal extension in parallel with an axis of said piston and corresponding in length at least to the stroke of the piston.

20. A pressure converter according to claim 17, wherein the valve bodies are diametrically positioned relative to an axis of the piston.

21. A pressure converter according to claim 1, further comprising a regulating device for the hydraulic motor.

22. A pressure converter according to claim 21, wherein the regulating device provides automatic control as a function of the pressure difference.

23. A pressure converter according to claim 1, wherein the hydraulic motor is a hydraulic gear wheel motor.

24. A pressure converter according to claim 1, wherein the valve device includes two separate valve bodies located in wall of said cylinder.

25. A pressure converter according to claim 24, wherein each valve body comprises at least one valve ball that rotates approximately 90° between open and closed positions.

26. A pressure converter according to claim 24, wherein each valve body has a longitudinal extension in parallel with an axis of said piston and corresponding in length at least to the stroke of the piston.

27. A pressure converter according to claim 24, wherein the valve bodies are diametrically positioned relative to an axis of the piston.

28. A pressure converter group for mounting above a drill bit at a lower end of a drill pipe for deep drilling and for generating fluid pressure higher than pressure in a drilling fluid flow downwards through a drill string and the drill pipe, the pressure converter group comprising:

a plurality of pressure converters, wherein at least one of the pressure converters includes:

a reciprocating piston having a pressure stroke and a return stroke between opposite end positions in a cylinder, and being provided at one side with a main piston area which during a pressure stroke is subjected to the drilling fluid pressure in the drill pipe, a first opposite piston area, and a second opposite piston area being relatively small compared to said main piston area, which during the pressure stroke generates said higher fluid pressure in a small portion of the drilling fluid flow;

a valve device that controls drilling fluid flow to and from the piston;

a channel for connecting a space in front of said first opposite piston area to an annulus outside the drill pipe at least during the pressure stroke;

a second channel with a check valve, connecting said small portion of the drilling fluid flow to a high pressure channel leading forward to the drill bit;

at least one additional channel providing fluid communication between the main piston area and the annulus outside the drill pipe during the return stroke;

a hydraulic rotary motor arranged outside one end of the cylinder and that can be driven by a pressure difference between the drilling fluid in the drill pipe and the annulus; and a transmission mechanism that converts the rotation of the hydraulic motor into movements of said valve device between at least two operative positions;

a high pressure channel running continuously through all pressure converters in the pressure converter group; and through-running couplings for transferring rotary movements from a valve body in one pressure converter to a valve body in another pressure converter in the pressure converter group.

29. A pressure converter group according to claim 28, wherein said valve bodies in said pressure converters have alternate, mutual angular displacements about common longitudinal axes for equalizing the resulting pressure impulses in the high pressure channel.

30. A pressure converter group according to claim 28, wherein the pressure converters in the pressure converter group do not have a separate control cylinder and actuator cylinder.

31. A pressure converter group according to claim 29, wherein said alternate, mutual angular displacements are 90°.

* * * * *